US008056441B2

(12) United States Patent
Lu

(10) Patent No.: US 8,056,441 B2
(45) Date of Patent: Nov. 15, 2011

(54) CONTROL KNOB DEVICE

(75) Inventor: Wen-Jen Lu, Taipei Hsien (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 455 days.

(21) Appl. No.: 12/427,747

(22) Filed: Apr. 22, 2009

(65) Prior Publication Data

US 2010/0269628 A1 Oct. 28, 2010

(51) Int. Cl.
*G05G 1/10* (2006.01)

(52) U.S. Cl. ..... 74/553; 74/10.7

(58) Field of Classification Search ..... 74/10 R, 74/10.2, 10.7, 526–531, 553, 557; 267/154–157, 267/163, 164
See application file for complete search history.

(56) References Cited

U.S. PATENT DOCUMENTS 2,530,795 A * 11/1950 Unk ..... 74/10.2
3,186,251 A * 6/1965 Quarfoot ..... 74/501.6
3,326,054 A * 6/1967 Canick et al. ..... 74/10.2
4,320,267 A * 3/1982 Greve et al. ..... 200/4
4,373,405 A * 2/1983 Geil ..... 74/531
6,530,718 B2 * 3/2003 Nygren et al. ..... 403/337
6,849,817 B2 * 2/2005 Takata et al. ..... 200/339
7,233,313 B2 6/2007 Levin et al.

* cited by examiner

*Primary Examiner* — Richard W Ridley
*Assistant Examiner* — Terence Boes

(57) ABSTRACT

A control knob device has a main body defining a top surface having a ring-shaped stopping wall with two inserting openings formed thereon, and a lateral surface having a guiding recess extending upwards and downwards and a sliding slot running circumferentially and communicating with the guiding recess, with the depth thereof greater than that of the guiding recess. A shell coupled to the main body has a covering plate with two blocking portions located outside the stopping wall and adjacent to the inserting openings, and a lateral plate extending inwards to form an inserting slice corresponding to the sliding slot. The shell is coupled to the main body by the inserting slice passing through the guiding recess and inserted into the sliding slot. Two elastic ends of a spring element are inserted into the inserting openings and abut against the blocking portions for making the rotated shell return automatically.

7 Claims, 5 Drawing Sheets

CONTROL KNOB DEVICE

BACKGROUND OF THE INVENTION

1. Field of the Invention

The present invention relates to a control knob device, and more particularly to a control knob device with a compact and simple assembling structure.

2. The Related Art

A control knob are used for various functions on many different types of device. Conventionally, the control knob, adapted for offering a degree of control to a user, is mounted to a main body of the device by a shaft. Related U.S. Pat. No. 7,233,313 entitled "Control Knob with Multiple Degrees of Freedom and Force feedback", which is incorporated herein by reference, teaches a structure that the control knob is rigidly coupled to a pusher member of the device by the shaft for achieving fine and coarse adjustment. However, such structure is complicated and occupies a biggish space, as a result, adding the manufacturing cost, the assembling time and the volume of the designed device.

SUMMARY OF THE INVENTION

Accordingly, an object of the present invention is to provide a control knob device with a compact and simple assembling structure. The control knob device has a main body defining a top surface and a lateral surface. The top surface has a stopping wall of ring shape, with two inserting openings formed thereon and apart from each other. The lateral surface has a plurality of guiding recesses extending upwards and downwards and a plurality of sliding slots, each of the sliding slots runs circumferentially and communicates with the corresponding guiding recess, with the depth thereof greater than that of the guiding recess. A shell coupled to the main body has a covering plate with two blocking portions located at an outer surface of the stopping wall and adjacent to the inserting openings, and a lateral plate having portions extending inwards to form a plurality of inserting slices corresponding to the sliding slots. A spring element is located within the stopping wall having two elastic ends. The shell is coupled to the main body by the inserting slices passing through the guiding recesses and inserted into the sliding slots. The elastic ends are inserted into the inserting openings and abut against the blocking portions for making the rotated shell return automatically.

As described above, the shell of the control device is fixed to the main body by the inserting slices sliding in the corresponding sliding slots. When the shell is rotated along different directions for achieving the adjustive function, the deformed spring element can provide the resilient force to make the rotated shell return automatically because the elastic end is moved along with the shell. Such assembling structure occupies a small space and is easy to manufacture and assemble.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
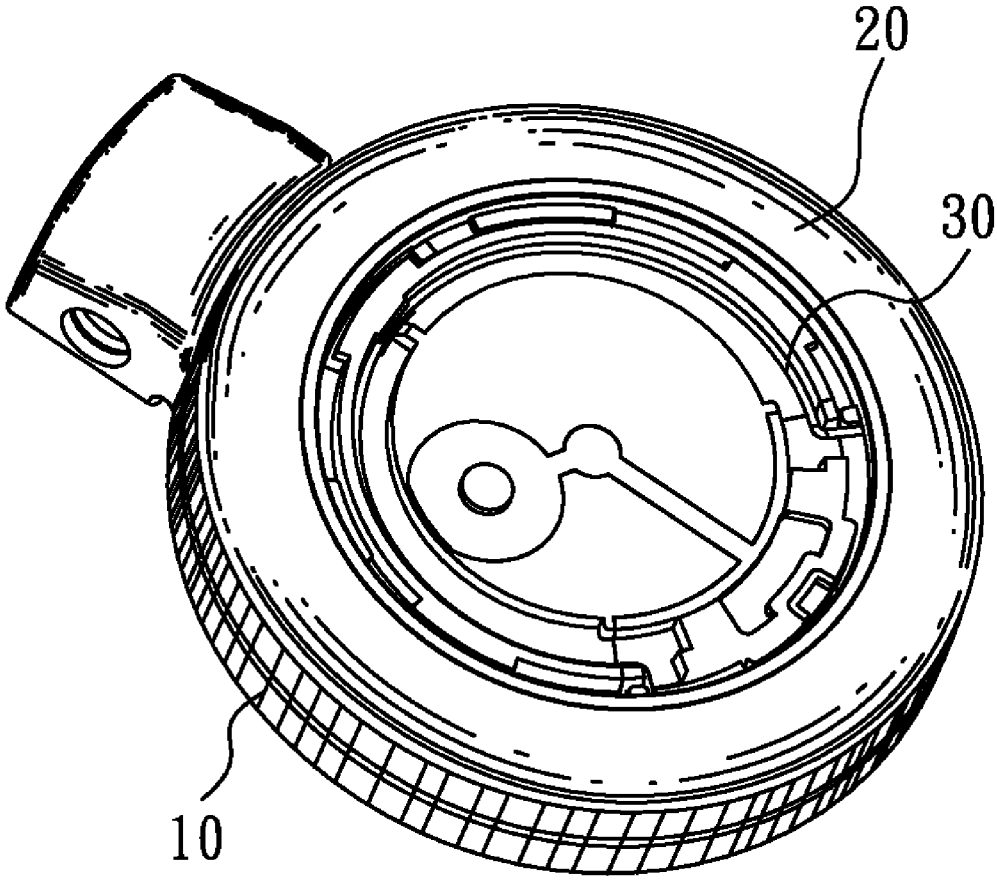
FIG. 1 is an assembled, perspective view of a control knob device of an embodiment according to the present invention.
Figure 2:
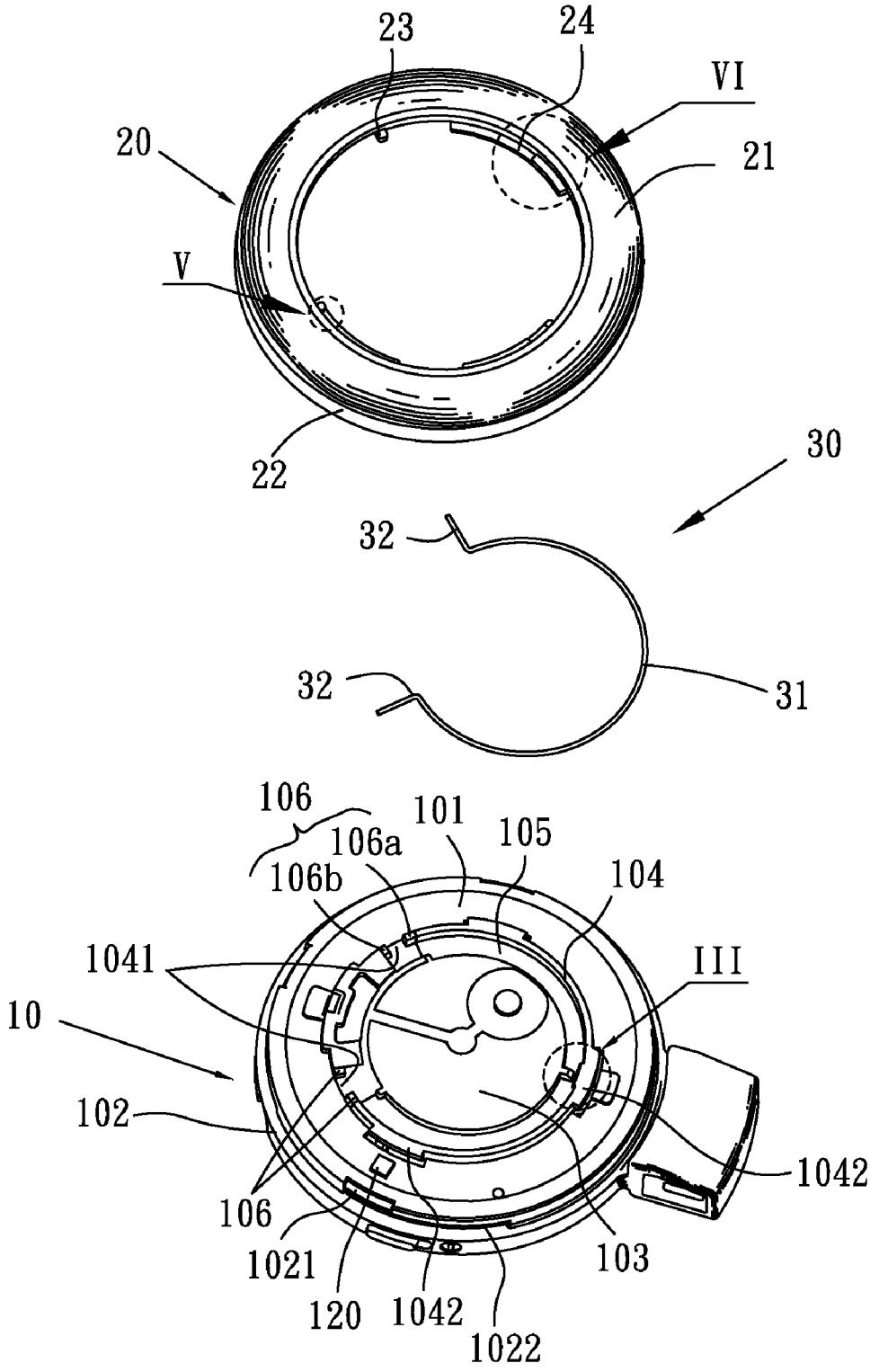
FIG. 2 is an exploded, perspective view of the control knob device shown in FIG. 1.
Figure 3:
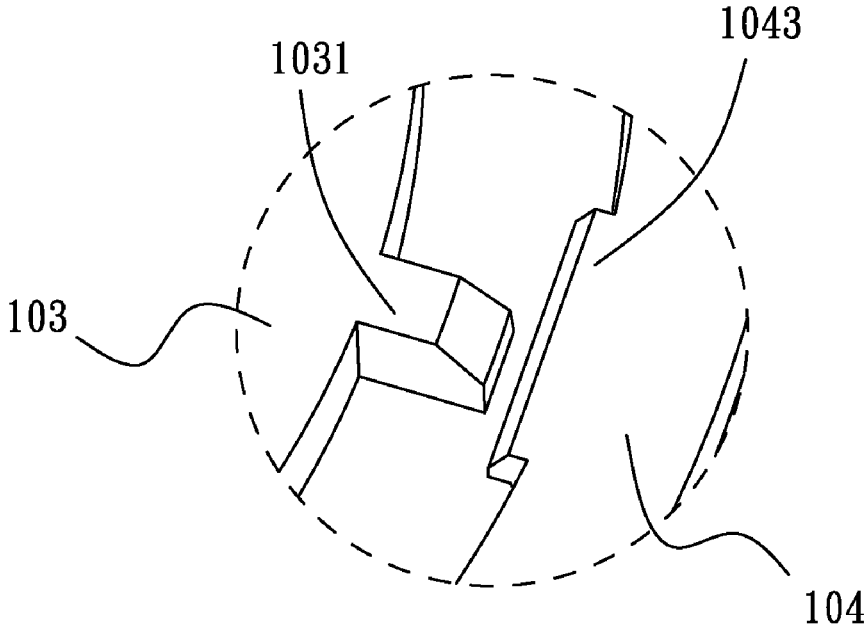
FIG. 3 is a partly enlarged view showing an enlarged III portion of FIG. 2.
Figure 4:
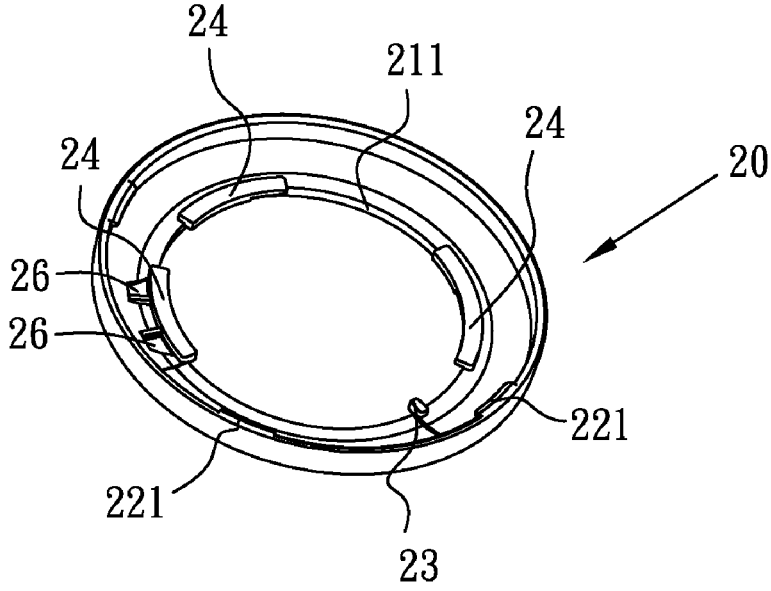
FIG. 4 is a perspective view of a shell of the control knob device shown in FIG 2 seen from a bottom view.
Figure 5:
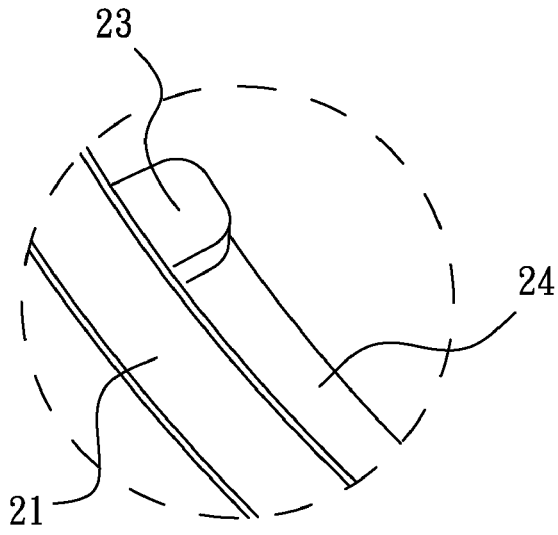
FIG. 5 is a partly enlarged view showing an enlarged V portion of FIG. 2.
Figure 6:
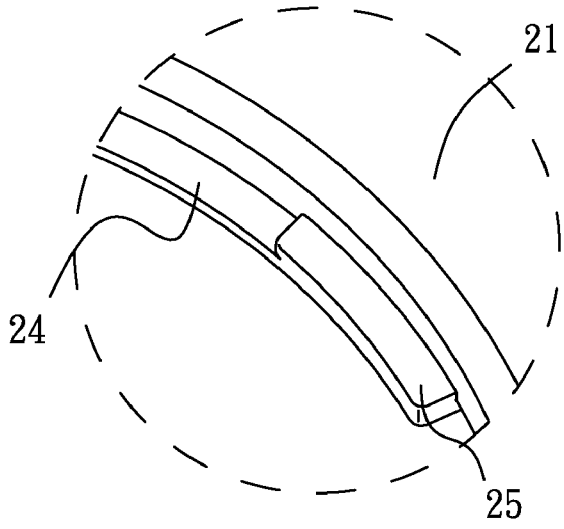
FIG. 6 is a partly enlarged view showing an enlarged VI portion of FIG. 2.
Figure 7:
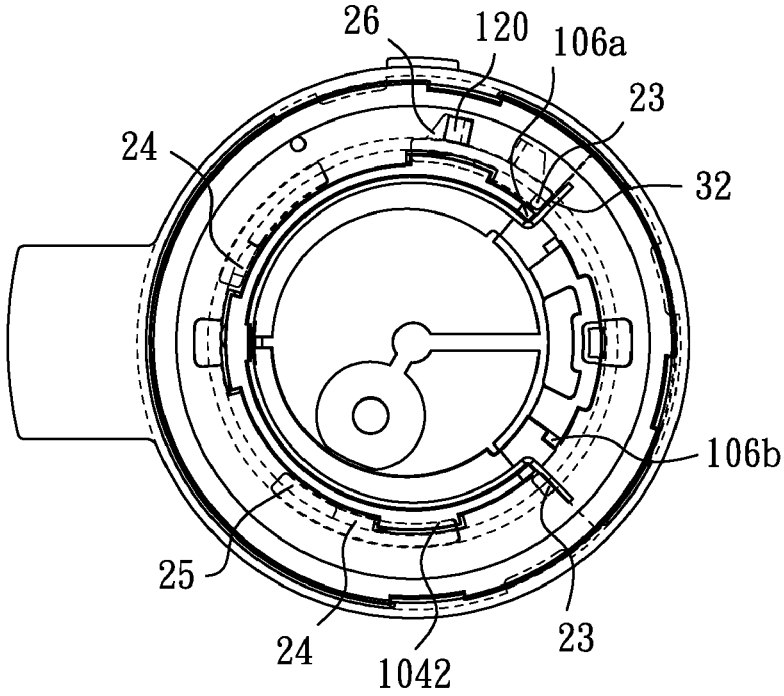
FIG. 7 is a plan view showing a state of the shell assembled to a main body of the control knob device shown in FIG. 2.
Figure 8:
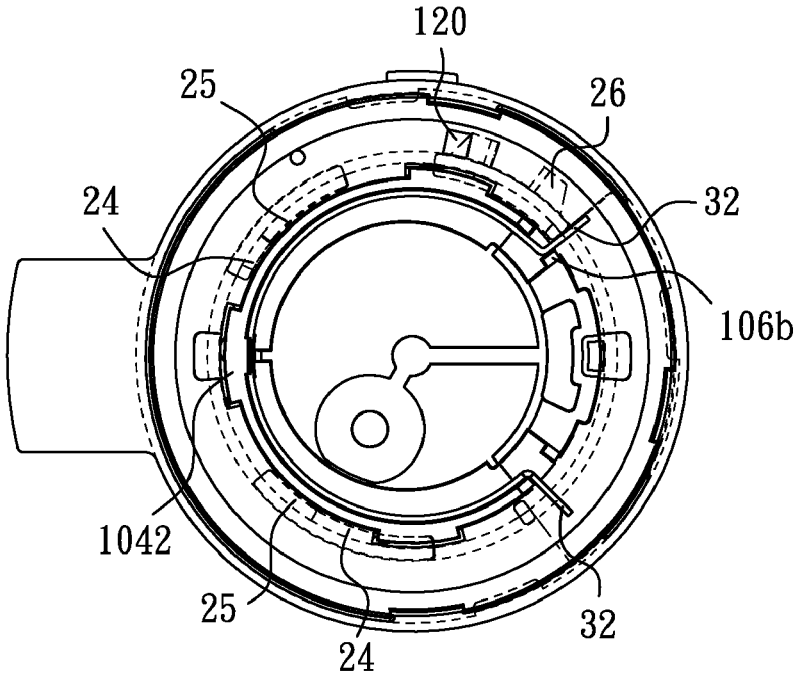
FIG. 8 is a plan view showing a state of the shell rotated with respect to the main body along a clockwise direction.

With reference to FIGS. 1-3, a control knob device is shown and has a main body 10 of cylindrical shape, a shell 20 coupled to the main body 10, and a spring element 30 assembled to the main body 10. The main body 10 defines a top surface 101 and a lateral surface 102. The lateral surface 102 has a plurality of guiding recesses 1021 extending upwards and downwards and passing through the top surface 101, and a plurality of sliding slots 1022. Each of the sliding slots 1022 runs circumferentially and communicates with a lower portion of the corresponding guiding recess 1021, and is with the depth thereof greater than that of the guiding recess 1021.

The top surface 101 has a circular platform 103 at a center thereof and a stopping wall 104 of ring shape surrounding the platform 103, with a receiving groove 105 formed therebetween. The platform 103 has a protruding lump 1031 at a periphery thereof and spaced away from the stopping wall 104. The stopping wall 104 has two inserting openings 1041 apart from each other with a predetermined distance. Two elastic elements 106 have first elastic lumps **106*a* and second elastic lumps 106*b*, which are respectively connected with ends of the stopping wall 104 formed the inserting openings 1041. An upper portion of an outer surface of the stopping wall 104 has portions extended outwards to form a plurality of stopping slices 1042. An inner surface of the stopping wall 104 has a portion facing the protruding lump 1031 protruding inwards to form a restraining portion 1043. The restraining portion 1043 is spaced away from the protruding lump 1031 with a short distance. In this embodiment, the restraining portion 1043 and the inserting openings 1041 are substantially located at three equal division points of the stopping wall 104. The top surface 101 further has a sensor 120 disposed at the outer surface of the stopping wall 104 and adjacent to one of the inserting openings 1041**.

Referring to FIG. 2 and FIGS. 4-6, the shell 20 has a covering plate 21 of ring shape and a cylindraceous lateral plate 22 extending downwards from a peripheral rim of the covering plate 21 and flanked to the lateral surface 102 of the main body 10. A bottom of the lateral plate 22 has portions extending inwards to form a plurality of inserting slice 221 corresponding to the sliding slots 1022. The covering plate 21 has two blocking portions 23, a plurality of sliding slices 24 and a plurality of stopping portions 25 at an inner rim 211 thereof. The blocking portion 23 is shaped as lump and located at an outer surface of the first elastic lump **106*a* after assembly, with an end thereof substantially flush with a free end of the first elastic lump 106*a*. The sliding slices 24 are extended downwards and bent inwards from the inner rim 211 of the covering plate 21 and slide under the corresponding stopping slices 1042 after assembly for avoiding the shell 20 separating from the main body 10. The stopping portion 25 is disposed at an end of the sliding slice 24 for blocking the stopping slice 1042 so as to limit rotary degree. In this embodiment, one of the blocking portions 23 is connected with an end of the sliding slice 24 for restraining the stopping slice 1042 as the stopping portion 25. Two lump-shaped magnets 26 are mounted at an outer surface of the sliding slice 24 connecting with the blocking portion 23** side by side.

With reference to FIG. 2, the spring element 30 has a spring body 31 and two elastic ends 32. The spring body 31, which may be curved with a metal wire to show a split-ring shape, is received in the receiving groove 105. Two ends of the metal wire are respectively bent outwards to form the elastic ends 32, inserted into the inserting openings 1041.

Please refer to FIGS. 1-2 and FIGS. 7-8, in assembly, the shell 20 is covered to the main body 10 and adjusted to make the inserting slices 221 align with the guiding recesses 1021, respectively. An external force is applied to the covering plate 21 of the shell 20 so that the inserting slices 221 are forced to pass through the guiding recesses 1021 and inserted into the sliding slots 1022. Then the shell 20 is rotated until the blocking portions 23 are aligned with the first elastic lumps 106*a*, respectively. The spring body 31 is placed in the receiving groove 105 and has a middle portion restrained between the protruding lump 1031 and the restraining portion 1043 for fixing the spring body 31. The elastic ends 32 are respectively inserted into the inserting openings 1041 and against the first elastic lumps 106*a* and the blocking portions 23, respectively.

The control knob device may be an audio device, a video device, or the like. Suppose that the control knob on the device is used to adjust the sound volume. The shell 20 is rotated clockwise to lower down the sound volume, contrarily, to raise the sound volume by counterclockwise direction. When the shell 20 is rotated clockwise, the sensor 120 is adapted for inducing the variation of the magnetic field generated by the magnets 26 and accordingly, sending a control signal to lower down the sound volume of the device. Meanwhile, one of the blocking portions 23 accompanying with the movement of the shell 20 drives the elastic end 32 to abut against the adjacent second elastic lump 106*b*. Then the elastic end 32 will automatically bring the blocking portion 23 to return the original position because of resilient force of the spring element 30.

As described above, the shell 20 of the control device is fixed to the main body 10 by the inserting slices 221 sliding in the corresponding sliding slots 1022. When the shell 20 is rotated along different directions for achieving the adjustive function, the deformed spring element 30 can provide the resilient force to make the rotated shell 20 return automatically because the elastic end 32 is moved along with the shell 20. In addition, the sliding slices 24 are disposed under the stopping slices 1042 for further fixing the shell 20 to the main body 10. Such assembling structure occupies a small space and is easy to manufacture and assemble.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A control knob device, comprising:

a main body of cylindrical shape defining a top surface and a lateral surface, the top surface having a stopping wall of ring shape, with two inserting openings formed thereon and apart from each other, the lateral surface having a plurality of guiding recesses extending upwards and downwards and a plurality of sliding slots, each of the sliding slots running circumferentially and communicating with the corresponding guiding recess, with the depth thereof greater than that of the guiding recess;

a shell coupled to the main body comprising a covering plate and a lateral plate enclosing the lateral surface, the covering plate having two blocking portions located at an outer surface of the stopping wall and adjacent to the inserting openings, the lateral plate having portions extending inwards to form a plurality of inserting slices corresponding to the sliding slots; and a spring element located within the stopping wall having two elastic ends, wherein the shell is coupled to the main body by the inserting slices passing through the guiding recesses and inserted into the sliding slots, the elastic ends are inserted into the inserting openings and abut against the blocking portions for making the rotated shell return automatically.

2. The control knob device as claimed in claim 1, wherein the top surface further has a circular platform surrounded by the stopping wall, with a receiving groove formed therebetween, the spring element has a spring body of split-ring shape received in the receiving groove.

3. The control knob device as claimed in claim 2, wherein the stopping wall has a portion extending inwards to form a restraining portion, a periphery of the platform is protruded towards the restraining portion to form a protruding lump, spaced away from the restraining portion with a distance, the spring body is restrained between the restraining portion and the protruding lump for fixing the spring body.

4. The control knob device as claimed in claim 3, wherein the inserting openings and the restraining portion are substantially located at three equal division points of the stopping wall.

5. The control knob device as claimed in claim 1, wherein the stopping wall has a plurality of stopping slices at an upper portion of an outer surface thereof, the covering plate of ring-shape has an inner rim extended downwards and bent inwards to form a plurality of sliding slices, the sliding slices are slid under the stopping slices for fixing the shell to the main body.

6. The control knob device as claimed in claim 5, wherein the inner rim of the covering plate further has a plurality of stopping portions, each of which is disposed at an end of the sliding slice for blocking the stopping slice.

7. The control knob device as claimed in claim 1, further comprising a first elastic lump and a second elastic lump, respectively connected with two ends of the stopping wall forming the inserting opening for elastically abutting against the elastic end of the spring element.

* * * * *